US007798349B2

(12) United States Patent
Maczek et al.

(10) Patent No.: US 7,798,349 B2
(45) Date of Patent: Sep. 21, 2010

(54) HOT-FILLABLE BOTTLE

(75) Inventors: Elizabeth D. Maczek, Westminster, CO (US); Kirk Firestone, Broomfield, CO (US)

(73) Assignee: Ball Corporation, Broomfield, CO (US)

( * ) Notice: Subject to any disclaimer, the term of this patent is extended or adjusted under 35 U.S.C. 154(b) by 823 days.

(21) Appl. No.: 11/672,754

(22) Filed: Feb. 8, 2007

(65) Prior Publication Data

US 2008/0190884 A1 Aug. 14, 2008

(51) Int. Cl.
*B65D 1/02* (2006.01)
*B65D 1/44* (2006.01)

(52) U.S. Cl. ..... 215/381; 215/382; 220/669; 220/673; 220/675

(58) Field of Classification Search ..... 215/381, 215/382, 384; 220/669, 672, 673, 675
See application file for complete search history.

(56) References Cited

U.S. PATENT DOCUMENTS 4,610,366 A * 9/1986 Estes et al. ..... 426/106
4,620,639 A 11/1986 Yoshino
D292,378 S 10/1987 Brandt et al.
4,946,053 A 8/1990 Conrad
5,011,648 A 4/1991 Garver et al. ..... 264/521
5,060,453 A 10/1991 Alberghini et al.
5,067,622 A 11/1991 Garver et al.
5,224,614 A 7/1993 Bono et al.
5,593,056 A 1/1997 Mero et al.
5,690,244 A 11/1997 Darr
5,704,504 A 1/1998 Bueno
5,762,221 A 6/1998 Tobias et al.
6,149,024 A 11/2000 Deemer et al.
D439,166 S 3/2001 Denner et al.
D441,660 S 5/2001 Denner et al.
6,230,912 B1 5/2001 Rashid
6,296,131 B2 10/2001 Rashid
D459,995 S 7/2002 Hong et al.
D475,615 S 6/2003 Podlucky
D478,817 S 8/2003 Yourist
6,612,451 B2 9/2003 Tobias et al.
6,662,960 B2 12/2003 Hong et al.
6,662,961 B2 12/2003 Yourist ..... 215/382
6,726,044 B1 4/2004 Deubel et al.

(Continued)

FOREIGN PATENT DOCUMENTS

EP 0 502 391 A2 2/1992

(Continued)

*Primary Examiner*—Sue A Weaver
(74) *Attorney, Agent, or Firm*—Brinks Hofer Gilson & Lione

(57) ABSTRACT

A base including an inwardly and upwardly projecting flexible surface within a continuous seating ring supports a generally cylindrical wall extending upward from the base. A plurality of annular inwardly projecting, and vertically flexible rings interrupting the cylindrical wall. At least one of rings projects inwardly more than some others of the rings to achieve an improved sidewall crush resistance A shoulder portion, includes a plurality of vertical ribs separating a plurality of vacuum responsive panels. The vertical flexibility of the bottle sidewall reduces the amount of flexing required in the shoulder panels and base to accommodate the same vacuum development, and enhances the total amount of post capping vacuum development that can be accommodated by the bottle as a whole.

14 Claims, 8 Drawing Sheets

U.S. PATENT DOCUMENTS

| | | | | |
|---|---|---|---|---|
| D495,602 | S | 9/2004 | Daly et al. | |
| 6,830,158 | B2 | 12/2004 | Yourist | |
| D501,400 | S | 2/2005 | Bretz et al. | |
| 6,857,531 | B2 | 2/2005 | Slat et al. | |
| 6,923,334 | B2 | 8/2005 | Melrose et al. | |
| 6,929,139 | B2 | 8/2005 | Darr | |
| 7,051,890 | B2 | 5/2006 | Onoda et al. | |
| 7,150,372 | B2 * | 12/2006 | Lisch et al. | 215/373 |
| 7,198,165 | B2 * | 4/2007 | Zhang | 215/381 |
| 2003/0116526 | A1 * | 6/2003 | Mehanna | 215/379 |
| 2004/0195199 | A1 * | 10/2004 | Maki et al. | 215/381 |
| 2004/0211746 | A1 * | 10/2004 | Trude | 215/374 |
| 2008/0197105 | A1 * | 8/2008 | Boukobza | 215/381 |

FOREIGN PATENT DOCUMENTS

| | | | |
|---|---|---|---|
| JP | 08-230855 | | 9/1996 |
| WO | WO 01/12511 | A1 | 2/2001 |
| WO | WO 02/18213 | A1 | 3/2002 |
| WO | WO 03/035485 | A1 | 5/2003 |
| WO | WO 2005/123517 | A1 | 12/2005 |
| WO | WO 2007/006880 | A1 * | 1/2007 |

* cited by examiner

HOT-FILLABLE BOTTLE

BACKGROUND

Blow-molded plastic bottles can be useful in containing hot-filled beverages and foods. The present disclosure relates particularly to a hot-filled plastic bottle that has increased flexibility through thinner wall thickness, yet retains a sidewall resistance to ovalization and other distortion that is at least as great as comparable bottles.

Garver et al., U.S. Pat. No. 5,067,622, discloses a bottle made of PET that is expressly configured for hot filled applications. The bottle's body sidewall is rigidized against radial and longitudinal vacuum distortion so that paper labels can be applied to the bottle. The rigidized sidewall is achieved by providing a plurality of radially inward, concave ring segments which are spaced apart from one another and separated from one another by cylindrically shaped flats or land segments. In addition, the amorphous threaded mouth of the bottle is rigidized by gussets molded into the bottle at the junction of the neck and shoulder portion of the bottle to resist deformation when the bottle is capped. To accommodate the post capping vacuum, a bulbous vacuum deformation area is provided in the shoulder adjacent the bottle neck, a plurality of vacuum deformation panels are provided in a frusto-conical portion of the shoulder, and a further vacuum deformation panel is provided in the base. As a result, any post capping vacuum is confined to the specifically designated areas of the bottle and the sidewall remains undistorted. The lack of post capping sidewall distortion is disclosed to be the result of a critical sizing of the ring segments relative to the land segments in combination, to some extent, with the crystallinity level, which is disclosed to be greater than 30%. Other bottles made of PET that have sidewall including spaced ring segments designed to rigidize the sidewall are disclosed, for example, in U.S. Pat. Nos. 6,923,334; 6,929,139 and 7,051,890.

Despite the various features and benefits of the structures of the forgoing and other similar disclosures, there remains a need for hot-fillable bottle made of plastic that has a price advantage achieved through a thinner wall thickness, yet retains a resistance to sidewall ovalization and other unwanted deformation that is at least as great as comparable bottles.

SUMMARY

These several needs are satisfied by a blow-molded bottle having a base including a generally continuous seating ring surrounding an inwardly and upwardly projecting flexible surface. A generally cylindrical wall extends upward from the base defining a longitudinal axis of the bottle. A plurality of annular inwardly projecting, and vertically flexible rings extend about the cylindrical wall perimeter interrupting the cylindrical wall. At least one of the plurality of rings projects inwardly more than some others of the plurality of rings. A shoulder portion extends upward from the cylindrical wall to a neck leading to a cappable opening. The shoulder includes a plurality of vertical ribs separating a plurality of vacuum responsive panels. The ends of the vertical ribs are smoothly continuous with the shoulder surface.

In one aspect, the seating ring of the base is sufficiently stable as to maintain a substantially constant diameter during changes in internal pressure of the bottle due to post capping shrinkage of the contents due to cooling. The stabilization of the base seating ring can be achieved by including a step immediately radially inside the lowest point of the seating ring. Flexibility is imparted to the inwardly and upwardly projecting surface within the seating ring and step by providing a convex portion between the step inside the seating ring and a central ring surrounding the longitudinal axis of the bottle. The central ring can define the outer perimeter of a shaped surface that can deflect and disburse incoming fluid during the filling operation.

In another aspect, the shoulder includes a circular ring defining a lower margin of the shoulder and a circular neck below the finish defining an upper margin of the shoulder. The ribs are in the form of upright columns arranged in spaced relation to each other between the upper and lower margins of the shoulder. The width of each of the ribs can be tapered from a wider lower end to a narrower upper end. An outer surface of the ribs is inwardly inclined from the lower end to the upper end and can have a substantially linear lower portion and a slightly bowed upper portion. The width of each of the plurality of flexible panels separating the upright columns can also be tapered from a wider lower portion to a narrower upper portion. The corners of the flexible panels at the junction of the ribs and margins can be arcuate to inhibit the initiation of creases or folds that can contribute to unwanted surface distortion.

In another aspect, the sidewall can be a series of generally cylindrical surfaces at a substantially constant radius from the longitudinal axis of the bottle. Each of the cylindrical surfaces is separated from adjacent cylindrical surfaces by an annular inwardly projecting and vertically flexible ring, there being a plurality of such rings over the vertical extent of the entire sidewall. At least one of the rings, situated between at least two others of the rings, projects inwardly more than the vertically adjacent rings, above and below, to provide resistance against radial collapse or ovalization of the cylindrical wall as a whole. More than one of the rings having the greater inward projection can be included in a single bottle sidewall, but uniform inward projection of the rings is to be avoided. The thickness of the cylindrical surfaces of the sidewall and the annular inwardly projecting rings is such that the sidewall as a whole can lengthen and shorten in response to pressure changes with the bottle.

One feature of the present invention is the use of increased controlled flexibility through proper shaping of the sidewall to achieve a resistance to sidewall ovalization or other radial deformation that is at least as great as comparable bottles, yet produced with a bottle having a price advantage achieved through a thinner wall thickness that accommodates the post capping vacuum that develops as a result of hot fill packaging of foods and beverages. The vertical flexibility of the bottle sidewall reduces the amount of flexing required in the shoulder panels and base to accommodate the same vacuum development. Alternatively, the enhanced vertical flexibility of the bottle sidewall enhances the total amount of vacuum development that can be accommodated by the bottle as a whole.

Other features of the present invention and the corresponding advantages of those features will be come apparent from the following discussion of the preferred embodiments of the present invention, exemplifying the best mode of practicing the present invention, which is illustrated in the accompanying drawings. The components in the figures are not necessarily to scale, emphasis instead being placed upon illustrating the principles of the invention. Moreover, in the figures, like referenced numerals designate corresponding parts throughout the different views.

DESCRIPTION OF PREFERRED EMBODIMENTS

Figure 1:
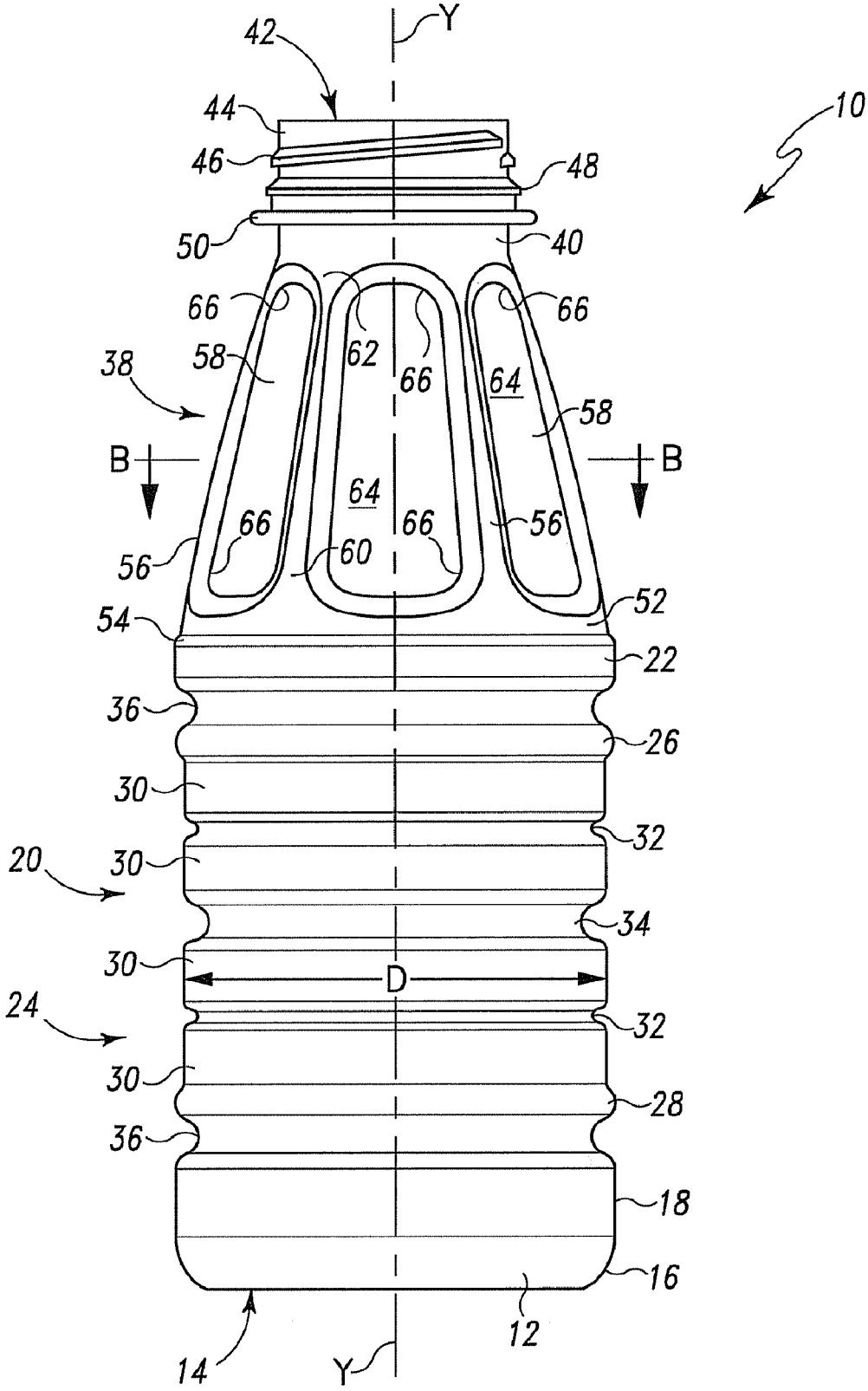
FIG. 1 is a side elevation view of a bottle embodying the present invention.

A bottle 10 of a first embodiment is shown in FIG. 1 in an un-distorted condition to have a base 12 including a generally continuous seating ring 14 capable of supporting the bottle 10 and any contents on an underlying surface, not shown. The base 12 includes a heel 16 outside the seating ring 14 that curves upward to a generally cylindrical portion 18. The cylindrical portion 18 can be considered as the upper margin of the base 12 and the lower margin of a generally cylindrical sidewall 20 that extends upward from the base 12 to an upper sidewall margin 22. The sidewall 20 is shown to be generally axially symmetric about a longitudinal axis Y of the bottle 10. The sidewall 20 includes a label panel portion 24 that extends between an upper label margin protrusion 26 and a lower label margin protrusion 28. The label panel portion 24 includes a plurality of cylindrical wall segments 30 having a constant diameter D. The cylindrical wall segments 30 are separated from each other by a plurality of annular inwardly projecting, and vertically flexible rings 32 that extend completely around the cylindrical wall perimeter to interrupt the vertical extent of the label panel portion 24. One of the rings 34 is seen to project inwardly more than the other rings 32. Additional annular inwardly projecting, and vertically flexible rings 36 are situated within the sidewall 20 above and below the label panel portion 24 to provide added vertical flexibility for the bottle while enhancing the resistance of the sidewall 20 to ovalization and other unwanted distortion. The additional rings 36 are shown to have an inwardly projecting dimension similar to that of ring 34. The inwardly projecting dimension of the rings 34 and 36 can be more than two times the inwardly projecting dimension of the rings 32.

A shoulder portion 38 extends upward from the upper sidewall margin 22 to a neck 40 leading to a cappable opening 42. The cappable opening 42 is shown to be surrounded by a finish 44 including a thread element 46 above a pilfer ring engaging feature 48 and a support ring 50. Finishes having other geometries and features can be used on the present containers in place of the illustrated finish 44. The shoulder portion 38 includes a smooth circumferentially continuous lower surface 52 immediately adjacent the upper sidewall margin 22. The continuous lower surface 52 is shown to be separated from the upper sidewall margin 22 by an optional cylindrically continuous step 54. The shoulder portion 38 also includes a plurality of vertical ribs 56 separating a plurality of vacuum responsive panels 58. The lower ends 60 of the vertical ribs 56 are smoothly continuous with the continuous lower surface 52 while the upper ends 62 of the vertical ribs 56 smoothly transition into the neck 40. The term "smoothly" is employed here to indicate the absence of any step or other demarcation between the ends 60 and 62 of the vertical ribs 56 and the vertically adjoining surfaces 52 and 40, respectively. The width of each of the ribs 56 is seen to be tapered from a wider lower end 60 to a narrower upper end 62. The vacuum responsive panels 58 include generally planar or slightly outwardly bowed surface 64 bounded by the vertical ribs 56 and the vertically adjoining surfaces 52 and 40. The corners 66 of the panels 58 are generally arcuate in the plane of the surface 64 to inhibit the initiation of creases or folds that can contribute to unwanted surface distortion.

Figure 2:
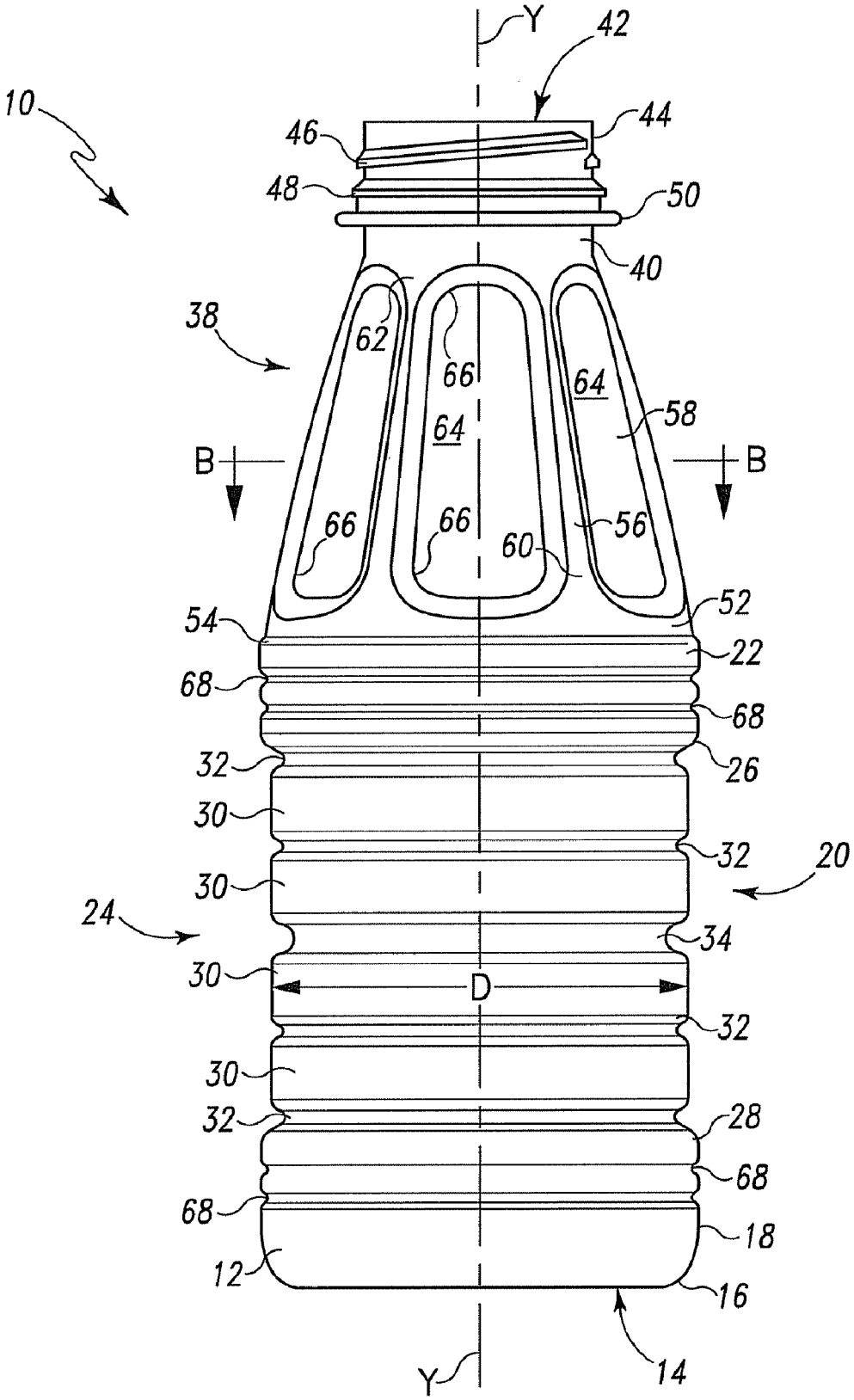
FIG. 2 is a side elevation view of a second bottle embodying the present invention.

A bottle 10 of a second embodiment is shown in FIG. 2 in an un-distorted condition to have a base 12 including a generally continuous seating ring 14 capable of supporting the bottle 10 and any contents on an underlying surface, not shown. The base 12 includes a heel 16 outside the seating ring 14 that curves upward to a generally cylindrical portion 18. The cylindrical portion 18 can be considered as the upper margin of the base 12 and the lower margin of a generally cylindrical sidewall 20 that extends upward from the base 12 to an upper sidewall margin 22. The sidewall 20 is shown to be generally axially symmetric about a longitudinal axis Y of the bottle 10. The sidewall 20 includes a label panel portion 24 that extends between an upper label margin protrusion 26 and a lower label margin protrusion 28. The label panel portion 24 includes a plurality of cylindrical wall segments 30 having a constant diameter D. The cylindrical wall segments 30 are separated from each other by a plurality of annular inwardly projecting, and vertically flexible rings 32 that extend completely around the cylindrical wall perimeter to interrupt the vertical extent of the label panel portion 24. Unlike the first embodiment, one of the rings 32 is situated immediately adjacent to the upper label margin protrusion 26 and another of the rings 32 is situated immediately adjacent to the lower label margin protrusion 28. Like the first embodiment, one of the rings 34 is seen to project inwardly more than the other rings 32. Additional annular inwardly projecting, and vertically flexible rings 68 are situated within the sidewall 20 above and below the label panel portion 24 to provide added vertical flexibility for the bottle while enhancing the sidewall crush resistance of the bottle. The additional rings 68 are shown to have an inwardly projecting dimension somewhat smaller than rings 32. The inwardly projecting dimension of the rings 34 can be more than three times the inwardly projecting dimension of the additional rings 68.

As in the first embodiment, a shoulder portion 38 of the second embodiment extends upward from the upper sidewall margin 22 to a neck 40 leading to a cappable opening 42. The cappable opening 42 is shown to be surrounded by a finish 44 including a thread element 46 above a pilfer ring engaging feature 48 and a support ring 50. The shoulder portion 38 includes a smooth circumferentially continuous lower surface 52 immediately adjacent the upper sidewall margin 22.

The continuous lower surface 52 is shown to be separated from the upper sidewall margin 22 by an optional cylindrically continuous step 54. The shoulder portion 38 also includes a plurality of vertical ribs 56 separating a plurality of inset vacuum responsive panels 58. The lower ends 60 of the vertical ribs 56 are smoothly continuous with the continuous lower surface 52 while the upper ends 62 of the vertical ribs 56 smoothly transition into the neck 40. The vacuum responsive panels 58 include generally planar or slightly outwardly bowed surface 64 bounded by the vertical ribs 56 and the vertically adjoining surfaces 52 and 40. The corners 66 of the panels 58 are generally arcuate in the plane of the surface 64 to inhibit the initiation of creases or folds that can contribute to unwanted surface distortion.

Figure 3:
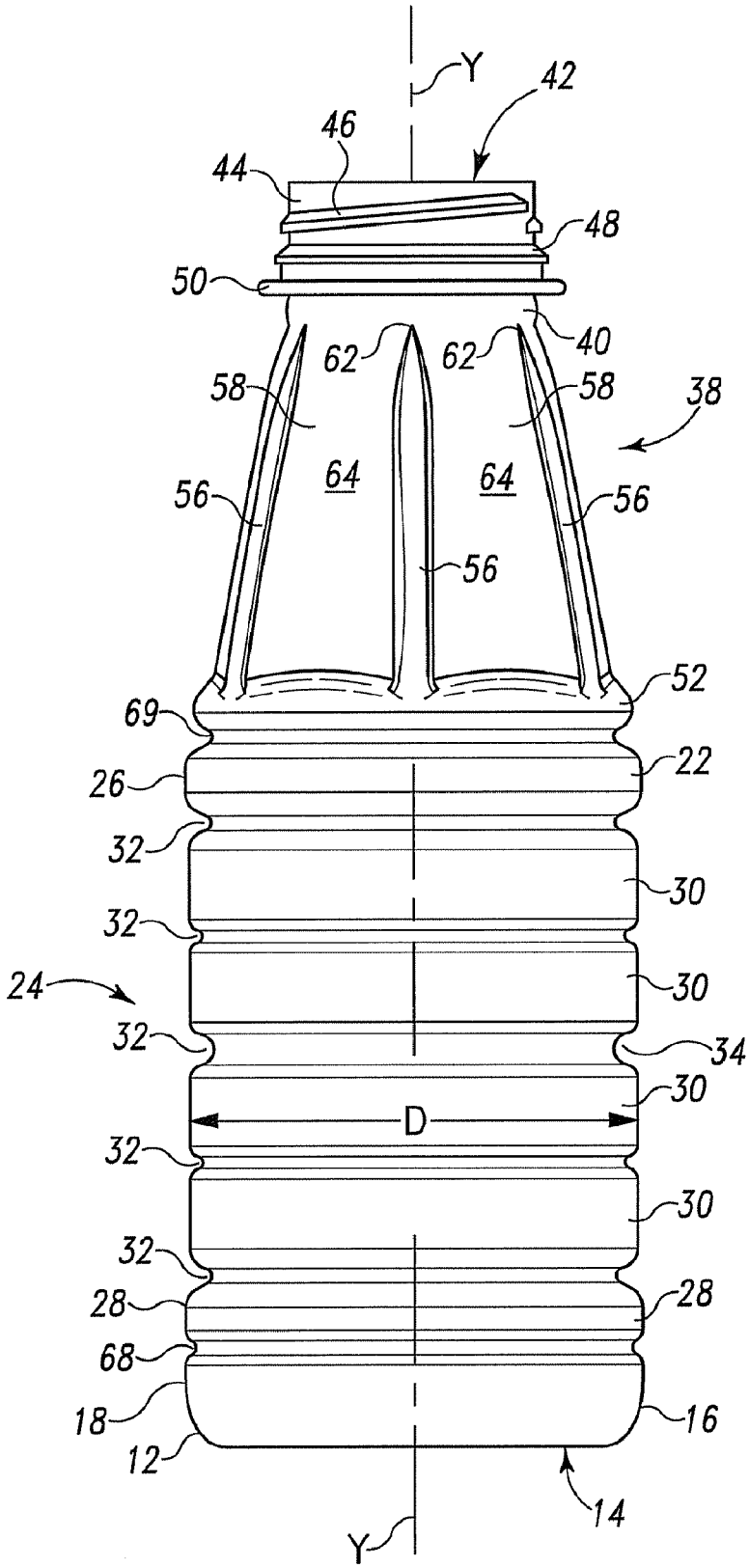
FIG. 3 is a side elevation view of a third bottle embodying the present invention.

A bottle 10 of a third embodiment is shown in FIG. 3 in an un-distorted condition to have a base 12 including a generally continuous seating ring 14 capable of supporting the bottle 10 and any contents on an underlying surface, not shown. The base 12 includes a heel 16 outside the seating ring 14 that curves upward to a generally cylindrical portion 18. The cylindrical portion 18 can be considered as the upper margin of the base 12 and the lower margin of a generally cylindrical sidewall 20 that extends upward from the base 12 to an upper sidewall margin 22. The sidewall 20 is shown to be generally axially symmetric about a longitudinal axis Y of the bottle 10. The sidewall 20 includes a label panel portion 24 that extends between an upper label margin protrusion 26 and a lower label margin protrusion 28. The label panel portion 24 includes a plurality of cylindrical wall segments 30 having a constant diameter D. The cylindrical wall segments 30 are separated from each other by a plurality of annular inwardly projecting, and vertically flexible rings 32 that extend completely around the cylindrical wall perimeter to interrupt the vertical extent of the label panel portion 24. Unlike the first embodiment, but similar to the second embodiment, one of the rings 32 is situated immediately adjacent to the upper label margin protrusion 26 and another of the rings 32 is situated immediately adjacent to the lower label margin protrusion 28. Like the first embodiment, one of the rings 34 is seen to project inwardly more than the other rings 32. An additional annular inwardly projecting, and vertically flexible ring 68 is situated within the sidewall 20 below the label panel portion 24 to provide added vertical flexibility for the bottle while enhancing the sidewall crush resistance of the bottle. The additional ring 68 is shown to have an inwardly projecting dimension somewhat smaller than rings 32. The inwardly projecting dimension of the rings 34 can be more than three times the inwardly projecting dimension of the additional ring 68.

A shoulder portion 38 of the third embodiment extends upward from an additional inwardly projecting ring 69 positioned above the upper sidewall margin 22 to a neck 40 leading to a cappable opening 42. The cappable opening 42 is shown to be surrounded by a finish 44 including a thread element 46 above a pilfer ring engaging feature 48 and a support ring 50. The shoulder portion 38 includes a smooth circumferentially continuous lower surface 52 immediately adjacent the inwardly projecting ring 69 above upper sidewall margin 22. The continuous lower surface 52 is shown to be separated from the upper sidewall margin 22 by the inwardly projecting ring 69. The shoulder portion 38 also includes a plurality of vertical ribs 56 separating a plurality of vacuum responsive panels 58. The lower ends 60 of the vertical ribs 56 are smoothly continuous with the continuous lower surface 52 while the upper ends 62 of the vertical ribs 56 smoothly transition into the neck 40. The vacuum responsive panels 58 include generally planar or slightly outwardly bowed surface 64 bounded by the vertical ribs 56 and the vertically adjoining surfaces 52 and 40. Unlike the first and second embodiments, the surfaces 64 of the vacuum responsive panels 58 smoothly blend into the neck 40 without any noticeable step or boundry.

Figure 4:
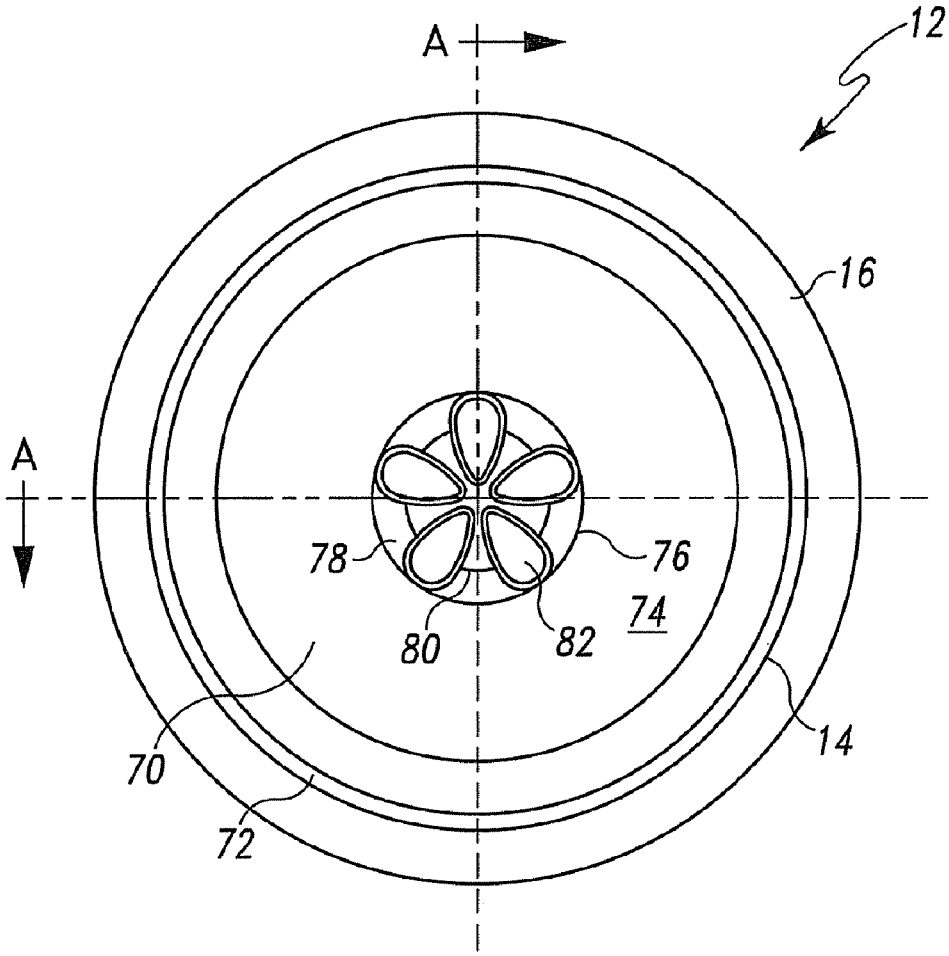
FIG. 4 is a bottom plan view of the bottles shown in FIGS. 1 through 3.
Figure 5:
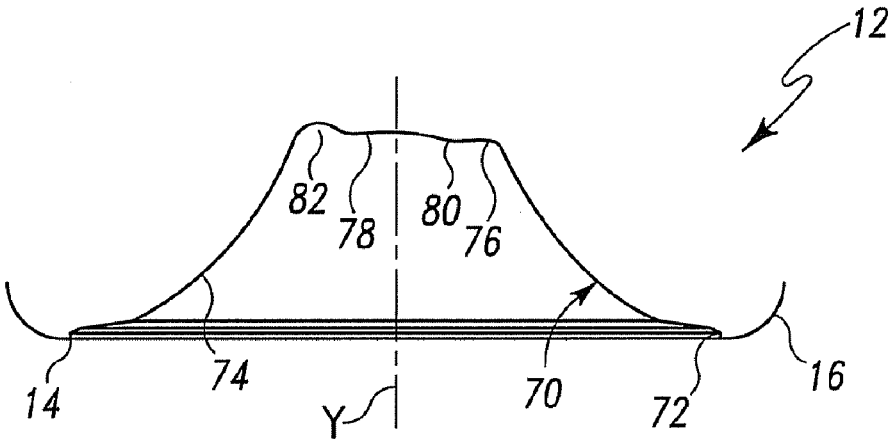
FIG. 5 is a partial vertical outline view of the outer surface of the base of the bottles in FIGS. 1 through 3 taken along line A-A of FIG. 4.

A base 12 that can be used on the various embodiments of bottle 10 is shown in FIGS. 4 and 5 in an un-distorted condition to include a heel 16 outside the seating ring 14 that curves upward to the generally cylindrical portion 18 shown in FIGS. 1, 2 and 3. The seating ring 14 surrounds an inwardly and upwardly projecting flexible surface 70. A step 72 can provided immediately radially inside the seating ring 14 that provides some radial stabilization for the seating ring 14. A convex portion 74 can extend inward from the step 72 to a central ring 76 surrounding the longitudinal axis Y of the bottle. The central ring 76 is shown to define the outer perimeter of a shaped surface 78 that is generally perpendicular to the axis Y. The shaped surface 78 can include a radial series of ribs 80 and depressions 82 that can assist in deflecting and disbursing incoming fluid during a filling operation of a bottle 10 incorporating the base 12.

Figure 6:
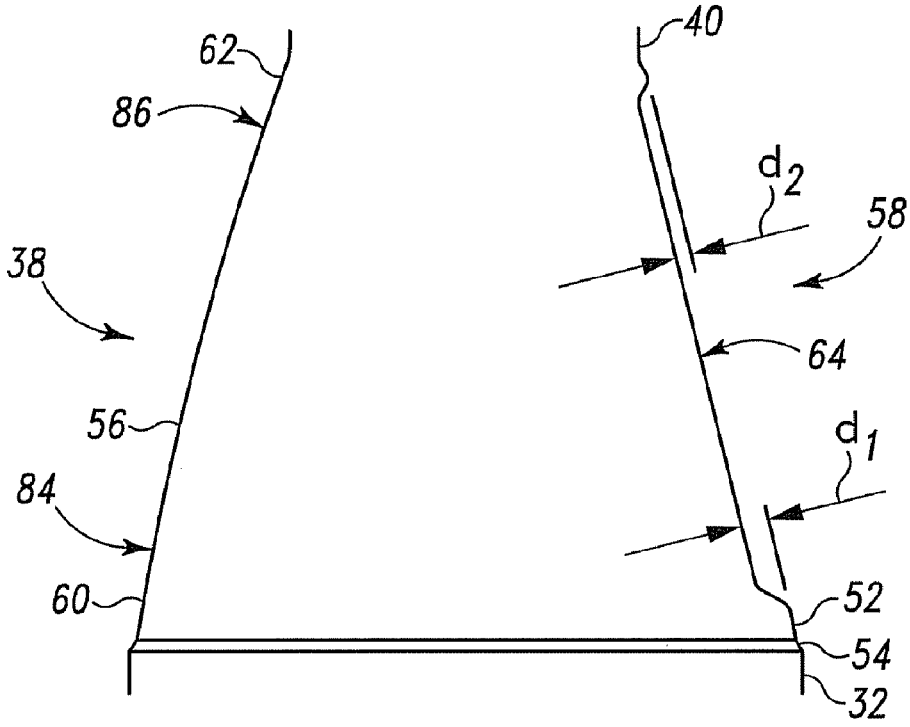
FIG. 6 is a partial vertical outline view of the outer surface of the shoulder of the bottles in FIGS. 1 through 3 taken along line A-A of FIG. 4.
Figure 7:
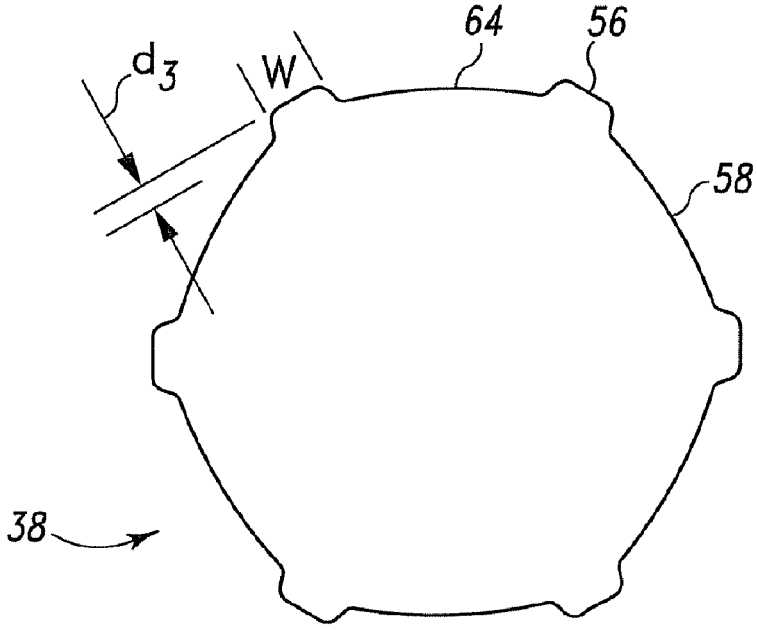
FIG. 7 is an outline view of the outer surface of the shoulder taken at line B-B of FIGS. 1 through 3.

FIGS. 6 and 7 show outline views of the outer surface of a shoulder portion 38 of a container 10 in an un-distorted condition. FIG. 6 shows the generally planar or slightly outwardly bowed surface 64 of the vacuum responsive panels 58 to be inset from the vertically adjoining surface 52 by a distance $d_1$ that is greater than the inset $d_2$ from the vertically adjoining surface 40 that defines the neck. In preferred embodiments of the container 10, the distance $d_1$ is at least twice the distance $d_2$. In the third embodiment of the container 10 shown in FIG. 3, the inset $d_2$ from the vertically adjoining surface 40 diminishes to essentially zero. It will also be seen that the lower ends 60 of the vertical ribs 56 are smoothly continuous with the continuous lower surface 52 while the upper ends 62 of the vertical ribs 56 smoothly transition into the neck 40. Further the portion 84 of the vertical ribs 56 near the lower ends 60 are generally planar while the portion 86 of the vertical ribs 56 near the upper ends 62 can be outwardly bowed. In horizontal cross-section, it will be seen that the outer surfaces 64 of the vacuum responsive panels 58 are outwardly bowed. In the plane defined by the line B-B shown in FIG. 7 the inset distance $d_3$ of the surface 64 is between the distances $d_1$ and $d_2$. In the plane defined by the line B-B the width w of each of the ribs 56 is less than at the lower end 60 and greater than at the upper end 62.

Figure 8:
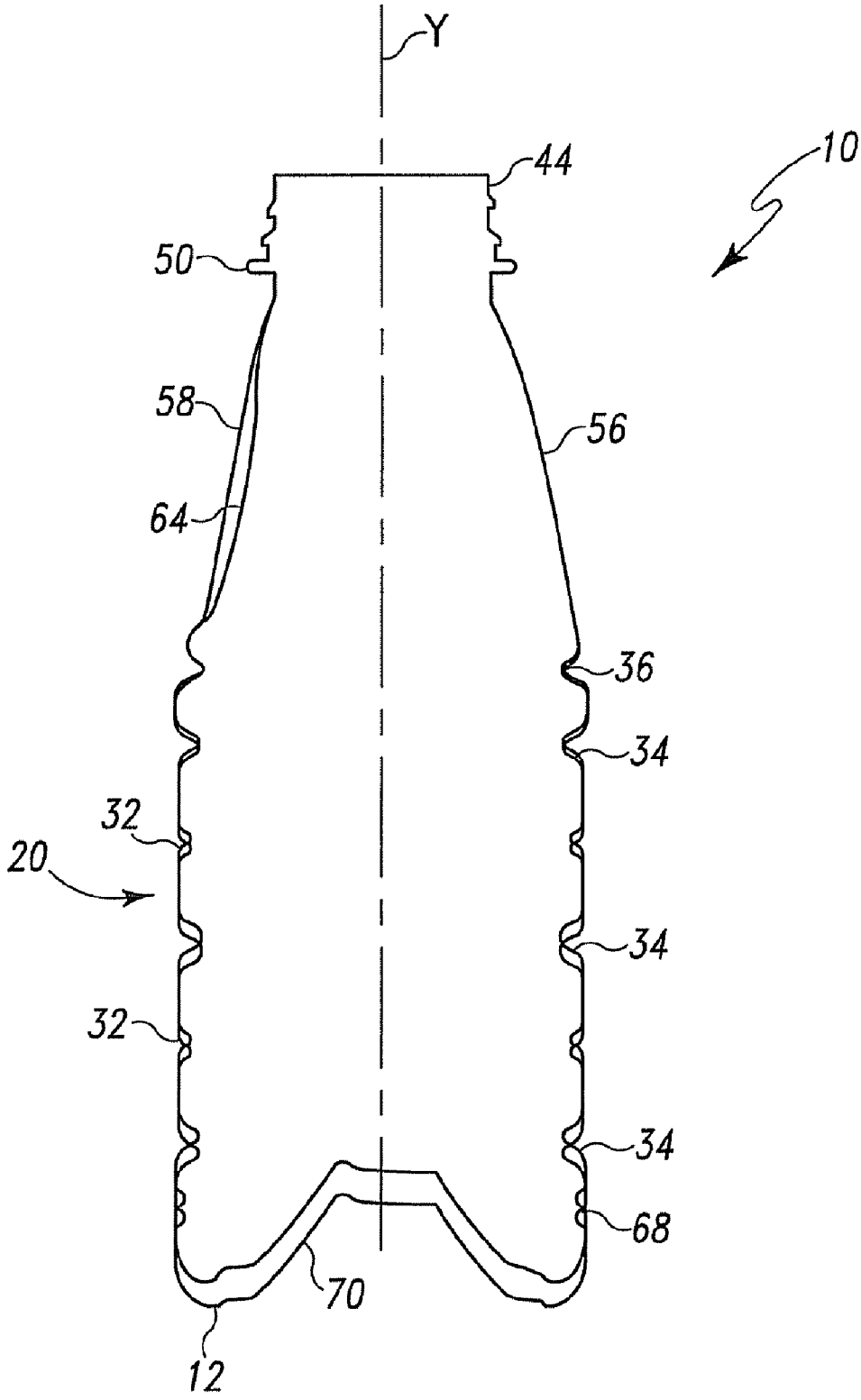
FIG. 8 is an overlapping outline view of the outer surface of a bottle of the present invention before and after being hot filled and capped, the view being taken along line A-A of FIG. 4.

FIG. 8 shows an overlapping outline of the outer surface of a bottle 10 before and after being hot filled and capped. The outline can be considered a view being taken along line A-A of FIG. 3 so that the left side of the figure passes through the center of a shoulder panel 58 and the right side of the figure passes through the center of a shoulder rib 56. The overlapping outlines are formed with the finish 44 exactly in line with all portions of the bottle 10 below the support ring 50 being free to move in response to the vacuum developed within the bottle as a result of the hot filling, capping and cooling. One observable change is a conventional and expected inward displacement of the surface 64 of the vacuum responsive panel 58 so that the surface 64 moves from a substantially planar or slightly convex configuration, as seen in FIG. 6, to a concave configuration. Another more dramatic change is an unconventional vertical movement of the base 12 in relation to the finish 44 so that the overall height of the container 10 is substantially shorter. This shortening of the overall height of the container 10 occurs substantially entirely within the sidewall 20 as a result of the vertical flexing of the rings 32, 34, 36 and/or 68. Some movement of the surface 70 within the base 12 also occurs, but may be difficult to see in FIG. 8.

Figure 9:
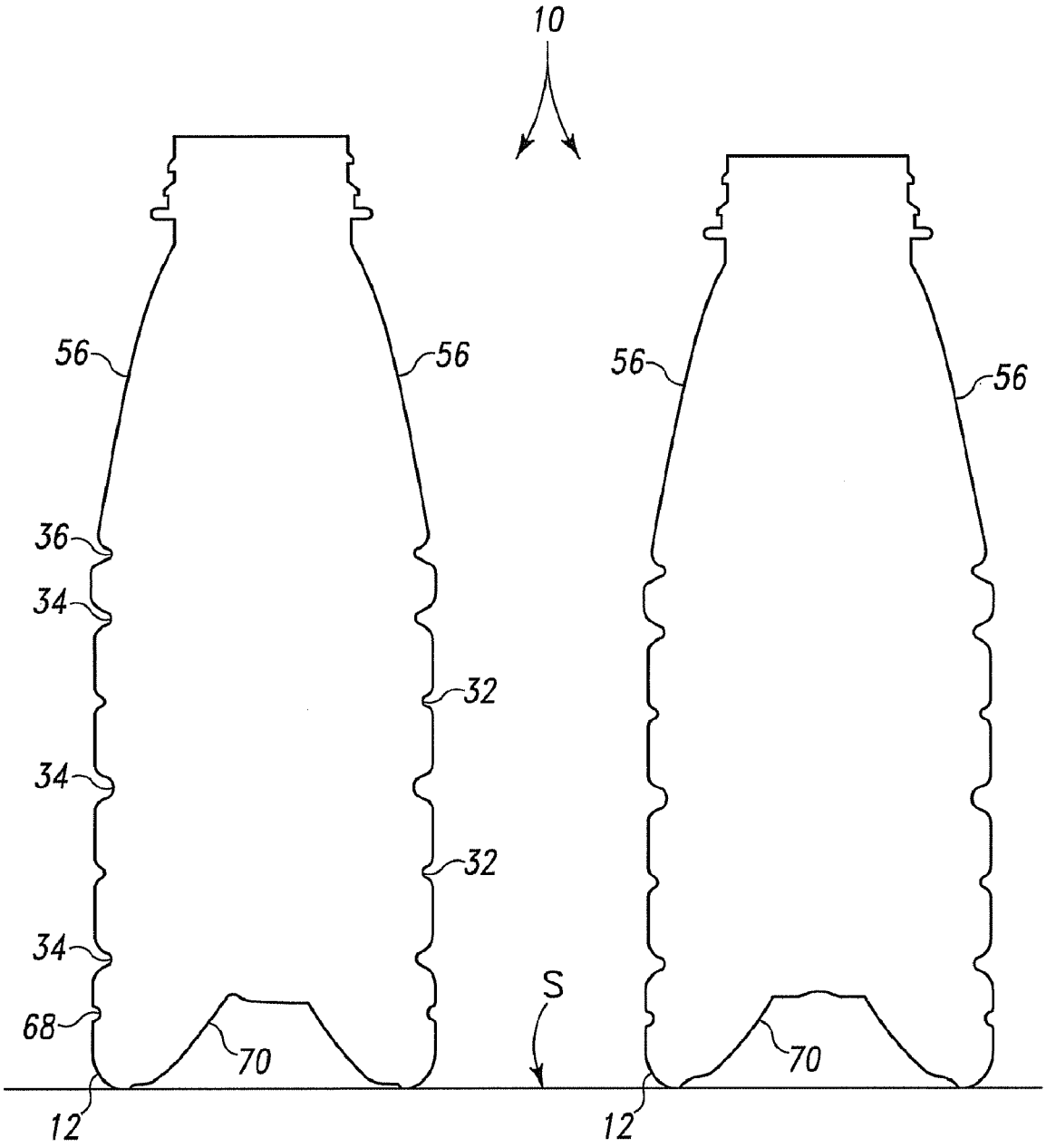
FIG. 9 is a side by side outline view of the outer surface of a bottle of the present invention before and after being hot filled and capped, the view being taken through the middle of the posts in the shoulder.
Figure 10:
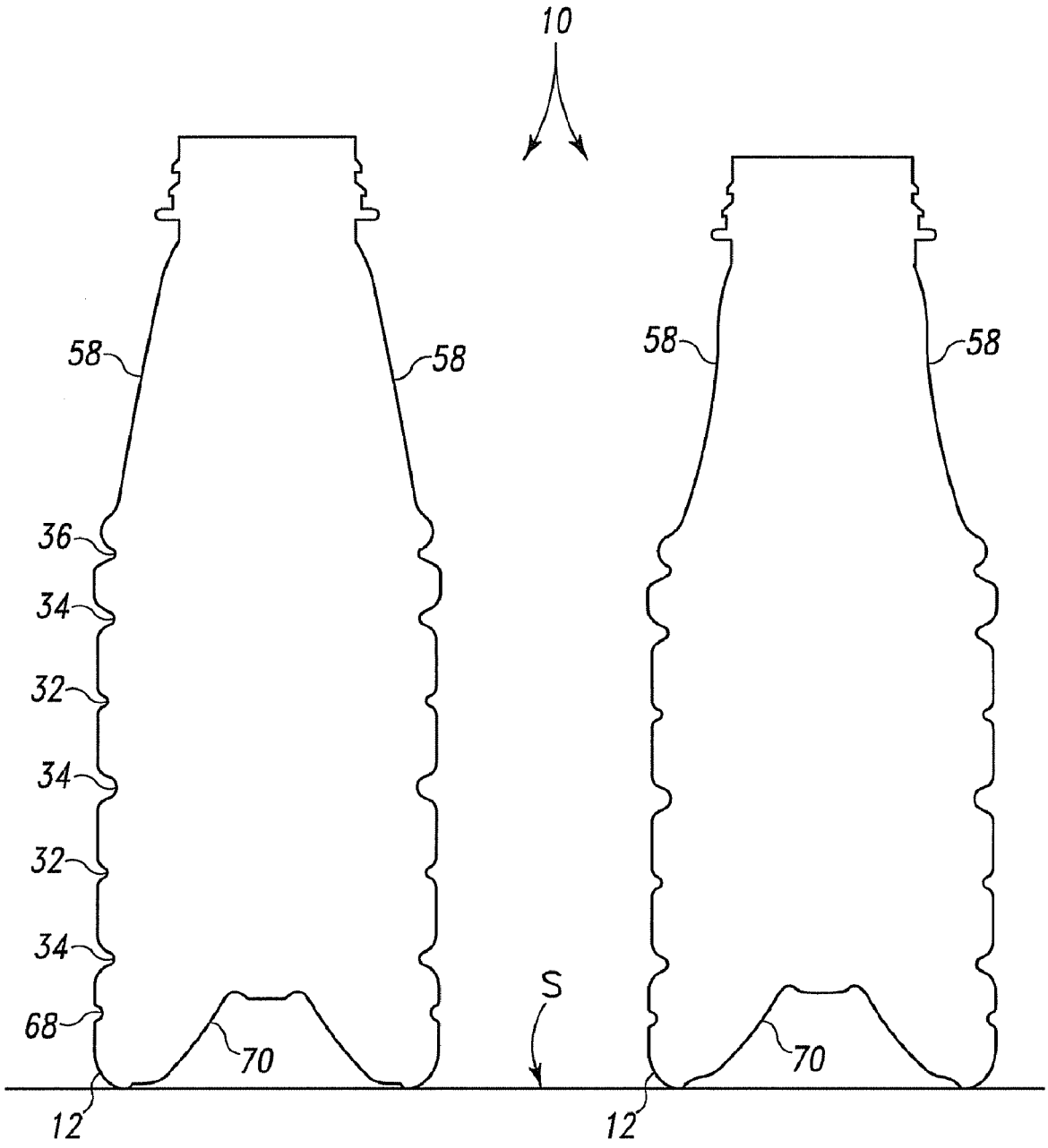
FIG. 10 is a side by side outline view of the outer surface of a bottle of the present invention before and after being hot filled and capped, the view being taken through the middle of the vacuum responsive panels in the shoulder.

FIGS. 9 and 10 show a side by side outline view of the outer surface of a bottle 10 before and after being hot filled, capped, and cooled. In FIG. 9, the view is taken through the middle of the shoulder ribs 56, while in FIG. 10 the view is taken through the middle of the shoulder vacuum response panels 58. In both FIGS. 9 and 10, the bottle 10 is assumed to be supported on a common surface S, and the remainder of the bottle 10 is allowed to move in response to the vacuum developed within the bottle 10 as a result of being hot filled, capped, and cooled. In these comparative views, the movement of the outer surface 70 with the base 12 is easier to be seen. The movement of the base surface 70 is not dramatic, although the volume displacement as a result of this movement is not insignificant. The movement of the vacuum responsive panel surfaces 64 is very apparent, but may be deceiving. The displaced volume as a result of the movement of the panel surfaces 64 is only moderate when compared with the change in volume that occurs as a result of the overall vertical shortening of the bottle 10 through the vertical flexing of the rings 32, 34, 36 and/or 68. The change in volume that occurs as a result of the overall vertical shortening of the bottle 10 has been found to be greater than the sum of the volumes displaced as a result of the movement of surfaces 64 and 70. This surprising result is achieved by thinning the sidewall 20 of the bottle 10 to increase the flexibility of the rings 32, 34, 36 and/or 68. The thinning is achieved by decreasing the amount of polymer used to form the bottle, which consequently also diminishes the cost of the bottle. Hence, a superior performing bottle is achieved at lower cost, yet the presence of the series of rings 32 and 34, and to a lesser extent 36 and/or 68, enable the bottle to withstand side impact and ovalization at least as well as comparable prior art bottles having more robust construction.

While these features have been disclosed in connection with the illustrated preferred embodiments, other embodiments of the invention will be apparent to those skilled in the art that come within the spirit of the invention as defined in the following claims.

What is claimed is:

1. A plastic bottle configured to resist unwanted deformation comprising:

a base including a continuous seating ring surrounding an inwardly projecting flexible surface, a cylindrical wall extending upward from the base defining a longitudinal axis, a plurality of annular inwardly projecting and vertically flexible rings extending about the cylindrical wall perimeter and interrupting the cylindrical wall, at least one of the plurality of rings projecting inwardly more than some others of the plurality of rings, and a shoulder portion extending upward from the cylindrical wall, the shoulder including a plurality of vertical ribs separating a plurality of vacuum responsive flexible panels, the vertical ribs having ends that are smoothly continuous with the shoulder surface.

2. A blow-molded, hot-fill bottle comprising:

a base including a continuous seating ring surrounding an inwardly projecting flexible surface, a body portion located above the base, the body portion having a cylindrical wall reinforced with a plurality of annular inwardly projecting rings interrupting the cylindrical wall and extending about the perimeter thereof, at least one of the plurality of rings projecting inwardly more than some others of the plurality of rings, at least some of the rings being vertically flexible, and a shoulder connected to a finish located above the body portion, the shoulder having circular ring defining a lower margin and a neck below the finish defining an upper margin, a plurality of upright ribs extending lengthwise of the shoulder in spaced relation between the upper and lower margins, a plurality of flexible panels separating the upright ribs and extending between the upper and lower margins, the flexible panels, inwardly projecting flexible surface of the base, and vertically flexible rings being adapted to flex in response to pressure changes in the bottle to accommodate entirely any vacuum induced in the bottle as a result of hot-fill processing.

3. A blow-molded, hot-fill plastic bottle comprising:

a base including a continuous seating ring surrounding an inwardly projecting flexible surface, a body portion located above the base, the body portion having a generally cylindrical wall with a plurality of annular inwardly projecting, vertically flexible, rings interrupting the cylindrical wall and extending about the perimeter thereof, at least one of the plurality of rings, situated between at least two others of the plurality of rings, projecting inwardly more than some others of the plurality of rings to provide resistance against radial collapse of the cylindrical wall, and a shoulder connected to a finish located above the body portion, the shoulder having circular ring defining a lower margin and a neck below the finish defining an upper margin, a plurality of upright ribs extending lengthwise of the shoulder in spaced relation between the upper and lower margins, a plurality of flexible panels separating the upright ribs and extending between the upper and lower margins, the flexible panels, inwardly projecting flexible surface of the base, and vertically flexible rings being of sufficient flexibility to flex in response to pressure changes in the bottle to accommodate entirely any vacuum induced in the bottle as a result of hot-fill processing.

4. The bottle of claim 1, 2 or 3, wherein the base further comprises a step radially inward from and adjacent to the seating ring of the base.

5. The bottle of claim 1, 2 or 3, wherein the base further comprises a central ring situated inside and above the seating ring surrounding the longitudinal axis of the bottle, and a shaped generally horizontal surface within the central ring.

6. The bottle of claim 5, wherein the base further comprises convex conical surface coupling the seating ring to the central ring.

7. The bottle of claim 1, 2 or 3, wherein each of the shoulder ribs has a width that is tapered from a wider lower end to a narrower upper end.

8. The bottle of claim 1, 2 or 3, wherein each of the shoulder ribs has an outer surface that is inwardly inclined from the rib lower end to the rib upper end.

9. The bottle of claim 8, wherein each of the shoulder ribs has an outer surface that is substantially linear adjacent the rib lower end and bowed adjacent the rib upper end.

10. The bottle of claim 1, 2 or 3, wherein each of the shoulder flexible panels is tapered in width from a wider lower portion to a narrower upper portion.

11. The bottle of claim 10, wherein each shoulder vacuum responsive panels comprises corners that are arcuate in the plane of the panel.

12. The bottle of claim 1, 2 or 3, wherein the cylindrical wall comprises a series of generally cylindrical surfaces at a substantially constant radius from the longitudinal axis of the bottle, each surface of the series being separated from an adjacent surface of the series by one of said annular inwardly projecting rings.

13. The bottle of claim 1 or 2, wherein said ring projecting inwardly more than other rings is situated between at least two other rings.

14. The bottle of claim 1, 2 or 3, comprising a plurality of said rings projecting inwardly more than other inwardly projecting rings of the sidewall.

* * * * *